US006691530B2

(12) United States Patent
Lee et al.

(10) Patent No.: US 6,691,530 B2
(45) Date of Patent: Feb. 17, 2004

(54) RAPID COOLING APPARATUS

(75) Inventors: Myung Ryul Lee, Seongnam-si (KR); Seong Jae Kim, Incheon-si (KR); Jang Seok Lee, Incheon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/244,375

(22) Filed: Sep. 17, 2002

(65) Prior Publication Data

US 2003/0209029 A1 Nov. 13, 2003

(30) Foreign Application Priority Data

May 13, 2002 (KR) ..... 2002-26097
May 13, 2002 (KR) ..... 2002-26099
May 13, 2002 (KR) ..... 2002-26100
May 13, 2002 (KR) ..... 2002-26101
May 13, 2002 (KR) ..... 2002-26102

(51) Int. Cl.[7] ..... F25D 25/00; F25D 3/02; F25D 11/04

(52) U.S. Cl. ..... 62/378; 62/379; 62/438

(58) Field of Search ..... 62/438, 295, 336, 62/378, 379, 381

(56) References Cited

U.S. PATENT DOCUMENTS 442,659 A * 12/1890 Beard ..... 165/88
496,922 A * 5/1893 Wadhams ..... 62/345
507,996 A * 11/1893 Cobin et al. ..... 366/213
511,209 A * 12/1893 Parker ..... 62/378
3,316,734 A * 5/1967 Crane ..... 62/381
4,078,397 A * 3/1978 Brande ..... 62/372
4,132,458 A * 1/1979 Leek ..... 312/305
4,164,851 A * 8/1979 Bryant ..... 62/381
4,549,409 A * 10/1985 Smith ..... 62/381
4,580,405 A * 4/1986 Cretzmeyer, III ..... 62/63
4,813,243 A * 3/1989 Woods et al. ..... 62/381
4,825,665 A * 5/1989 Micallef ..... 62/372
5,005,378 A * 4/1991 Ottenheimer ..... 62/378
5,156,008 A * 10/1992 Olsson et al. ..... 62/63
5,282,368 A * 2/1994 Ordoukhanian ..... 62/372
5,428,972 A * 7/1995 Germain ..... 62/374
5,966,964 A * 10/1999 Pattee ..... 62/457.4
6,314,751 B1 * 11/2001 Gjersvik ..... 62/457.4

* cited by examiner

*Primary Examiner*—William C. Doerrler
(74) *Attorney, Agent, or Firm*—Fleshner & Kim, LLP

(57) ABSTRACT

The present invention relates to a rapid cooling apparatus for rapidly cooling objects at room temperature via conductive heat transfer and convective heat transfer as well. The rapid cooling apparatus comprises: means having a storage space disposed inside a first storage housing for storing the objects to be cooled and cold material bags disposed around the received objects to be cooled; means for driving the storage means in a direction; and means for spacing the storage and driving means from a second storage housing. The invention provides a user with convenience via rapid cooling and also can enhance cooling efficiency.

36 Claims, 10 Drawing Sheets

RAPID COOLING APPARATUS

BACKGROUND OF THE INVENTION

1. Field of the Invention

The present invention relates to a rapid cooling apparatus for rapidly cooling objects at room temperature via conductive heat transfer and convective heat transfer as well.

2. Description of the Related Art

At present, refrigerators are essential electric equipments for keeping fruits or vegetables in the fresh state and for freezing or refrigerating meats and fishes which readily rot. Such refrigerators are useful means for not only home but also the industry.

FIG. 1 is a perspective view of a general refrigerator. Referring to FIG. 1, the refrigerator is typically divided into a freezing chamber 1 and a refrigerating chamber 2. A user would store or take out foods into/out of the freezing and refrigerating chambers 1 and 2.

In general, drinkables are stored in the refrigerating chamber 2 or in particular in storage rooms 3 for drinkables furnished in a door of the refrigerating chamber 2. When the drinkables are stored in the refrigerating chamber or in the refrigerating chamber door, it takes a long time until the drinkables are cooled down to a low temperature from a room temperature. Of course, the cooling time is shortened when the drinkables are stored in the freezing chamber in order to shorten the cooling time. However, it also takes about 20 minutes until the drinkables reach the low temperature state even though the cooling time is shortened. That is to say, the freezing chamber can shorten the cooling time required for cooling the drinkables compared to the refrigerating chamber since it has a temperature of about −18° C.

Even though it is consumed for about 20 minutes that the user stores the drinkables into the freezing chamber for cooling the same which is shorter than the storage time in the refrigerating chamber, busy modem people cannot readily wait for 20 minutes in order to drink the drinkables in low temperature since they take serious considerations to 1 minute and even to 1 second.

Therefore it is needed to develop an apparatus capable of cooling drinkables from a room temperature to a low temperature more rapidly.

FIG. 2 illustrates a conventional method for rapidly cooling drinkables. Referring to FIG. 2, a cover cloth 6 is spread on a surface, ice lumps 4 are disposed around drinkable vessels 7 (hereinafter will be referred to be 'objects to be cooled' or simply 'objects' for the convenience's sake of description), salt 5 is scattered on the ice lumps 4, and then the cover cloth 6 is wrapped around the objects 7 to be cooled. Then heat transfer starts from the objects 7 to be cooled in a room temperature to the ice lumps 4 in a low temperature since the objects 7 to be cooled contact with the ice lumps 4. In this case, the cover cloth 6 is adapted to block external heat from migrating into the ice lumps or external air from penetrating within the cover cloth 6.

The objects 7 to be cooled would be continuously rotated in order to transfer heat more effectively from the objects 7 to be cooled to the ice lumps 6.

According to this method, however, ice and salt readily dissolve and thus it is required to replace ice and salt frequently. Furthermore, this method disadvantageously accompanies with difficulties in use, for example, water created owing to dissolution of ice makes the surface messy.

SUMMARY OF THE INVENTION

Accordingly, the present invention has been made to solve the foregoing problems and it is an object of the present invention to provide a rapid cooling apparatus for cooling objects to be cooled at a room temperature to a low temperature in a very short time period.

It is another object of the invention to provide a rapid cooling system and method for rapidly cooling objects to be cooled with a smaller amount of electric energy.

According to an aspect of the invention to obtain the above objects, it is provided a rapid cooling apparatus for rapidly cooling objects to be cooled, comprising: means having a storage space disposed inside a first storage housing for storing the objects to be cooled and cold material bags disposed around the received objects to be cooled; means for driving the storage means in a direction; and means for spacing the storage and driving means from a second storage housing.

In the rapid cooling apparatus, the cold material bags are filled with cold material and attached to inside walls, the cold material may comprise ethyl alcohol or saline. The cold material is desirable to maintain two-phase state at the regular temperature range.

The rapid cooling apparatus may further comprise an evaporator inserted into the first storage housing, wherein the evaporator may operate in cooperation with a cooling cycle. The rapid cooling apparatus may further comprise heat-insulating material disposed outside the second storage housing.

Where the driving means comprise vibration means for vibrating the storage means, the vibration means may be fixed to the storage means via a connector shaft, wherein the vibration means may include: a vibration motor fixed inside a vibration housing; and an eccentric weight rotating as coupled to a shaft of the vibration motor.

Where the driving means comprise rotation means for rotating the storage means, the rotation means may include: a rotation motor for generating rotation force; a first rotation shaft for coupling the rotation motor with one side of the storage means to transfer rotation force; and a second rotation shaft for coupling between the other side of the storage means and a rotation shaft support to support the storage means, wherein the second rotation shaft may be inserted into bearings of the rotation shaft support. The rotation motor continuously rotates in one of forward and reverse directions, and the rapid cooling apparatus may further comprise a clutch for switching rotation executed in one direction by the rotation motor, whereby the rotation inverts its direction.

Where the rotation motor is a DC motor which rotates alternately in forward and reverse directions, the DC motor may rotate alternately in forward and reverse directions under the control of means for controlling rotation.

The rapid cooling apparatus may further comprise resonance means for controlling so that an excitation frequency corresponds to a resonant frequency.

According to an aspect of the invention to obtain the above objects, it is provided a rapid cooling system for rapidly cooling objects to be cooled, comprising: means having a storage space disposed inside a first storage housing for storing the objects to be cooled and cold material bags disposed around the received objects to be cooled; means for laterally vibrating the storage means; resonance means for controlling so that an excitation frequency detected from the storage means corresponds to resonance frequency, and means for spacing the storage and vibration means from a second storage housing.

According to further another aspect of the invention to obtain the above objects, it is provided a rapid cooling system for rapidly cooling objects to be cooled, comprising: means having a storage space disposed inside a first storage housing for storing the objects to be cooled and cold material bags disposed around the received objects to be cooled; means for rotating the storage means in a reciprocating direction; and rotation control means for controlling the rotation means to rotate in the reciprocating direction.

According to other aspect of the invention to obtain the above objects, it is provided a rapid cooling apparatus for rapidly cooling objects to be cooled, comprising: means having a storage space disposed inside a first storage housing for storing the objects to be cooled, cold material bags disposed around the received objects to be cooled and an evaporator inserted into the first storage housing; means for driving the storage means in a direction; and means for spacing the storage and driving means from a second storage housing.

According to another aspect of the invention to obtain the above objects, it is provided a rapid cooling apparatus for rapidly cooling objects to be cooled, comprising: means having a storage space disposed inside a first storage housing for storing the objects to be cooled and cold material bags disposed around the received objects to be cooled; means for laterally vibrating the storage means; and means for spacing the storage and vibration means from a second storage housing.

According to a further another aspect of the invention to obtain the above objects, it is provided a rapid cooling apparatus for rapidly cooling objects to be cooled, comprising: means having a storage space disposed inside a first storage housing for storing the objects to be cooled and cold material bags disposed around the received objects to be cooled; means for rotating the storage means and having a first rotation shaft and a second rotation shaft, the first rotation shaft being extended from one side of the storage means to a rotation motor, and the second rotation shaft extended from the other side of the storage means and inserted into a rotation shaft support; and means for spacing the storage and vibration means from a second storage housing.

According to another aspect of the invention to obtain the above objects, it is provided a rapid cooling system for rapidly cooling objects to be cooled, comprising: means having a storage space disposed inside a first storage housing for storing the objects to be cooled and cold material bags disposed around the received objects to be cooled; means for laterally rotating the storage means; resonance control means for calculating an excitation frequency based upon variation in voltage detected from vibration of the storage means, and controlling the rate of the vibration means so that the excitation frequency corresponds to the resonant frequency, and means for spacing the storage and vibration means from a second storage housing.

According to a still another aspect of the invention to obtain the above objects, it is provided a method for rapidly cooling objects to be cooled in a refrigerator, the method comprising the steps of: detecting, by detection means, vibration generated from storage means to output a voltage signal; calculating, by resonance control means, an excitation frequency based upon variation of the voltage signal to output a control signal if the excitation frequency corresponds to a resonant frequency of the storage means; changing the rate of rotation according to the control signal; and generating, by the storage means, vibration according to the changed rotation rate.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

The following detailed description will present a preferred embodiment of the invention in reference to the accompanying drawings.

Figure 1:
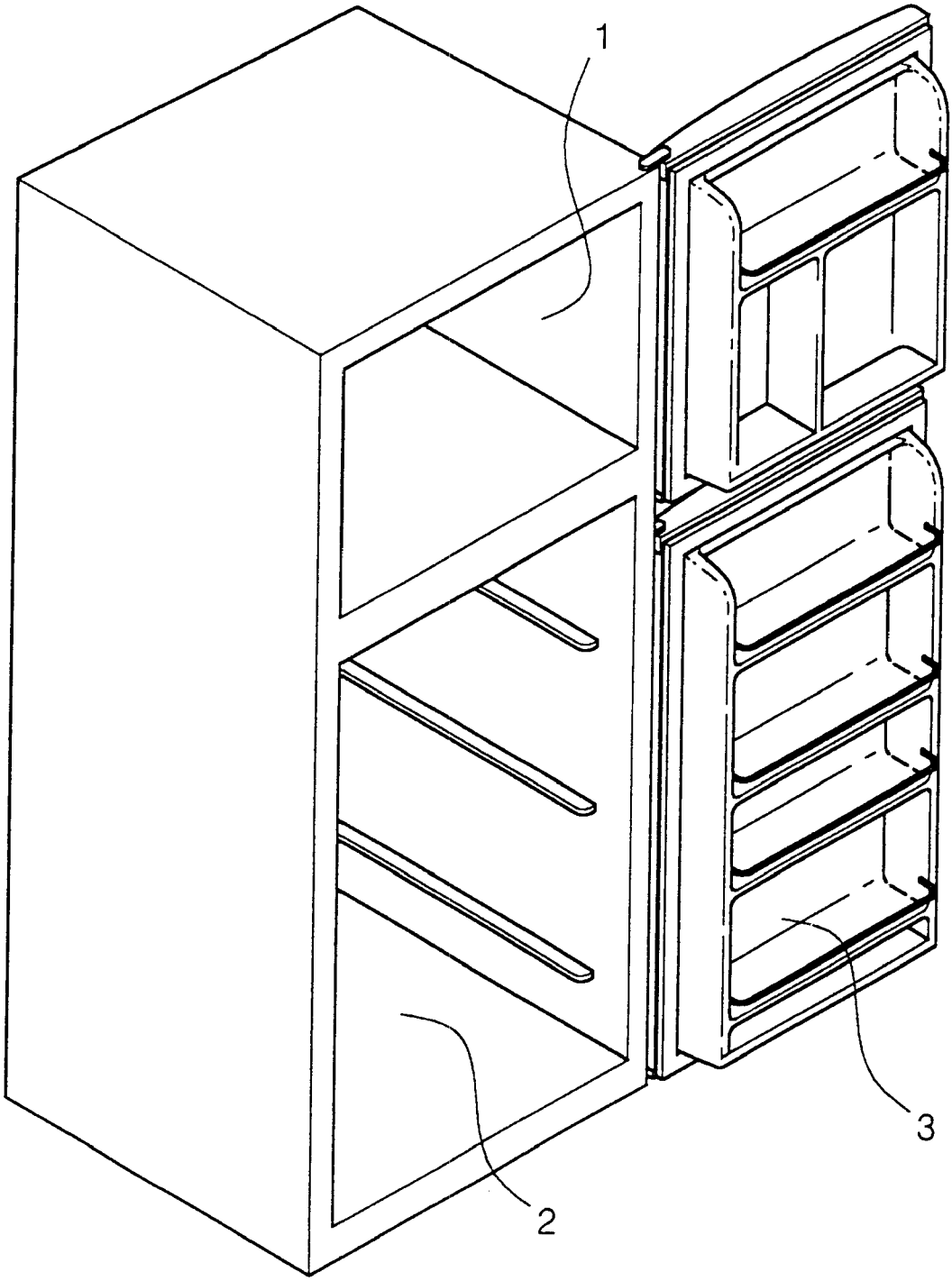
Fig. 1 (Related Art)
FIG. 1 is a perspective view of a general refrigerator.
Figure 2:
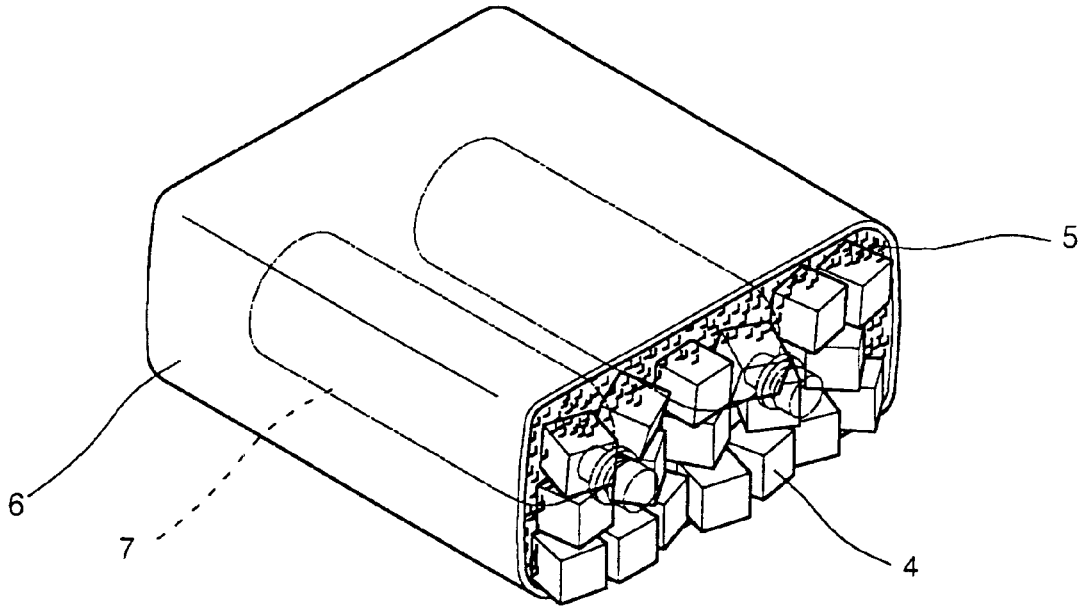
Fig. 2 (Related Art)
FIG. 2 illustrates a conventional method for rapidly cooling drinkables.
Figure 3:
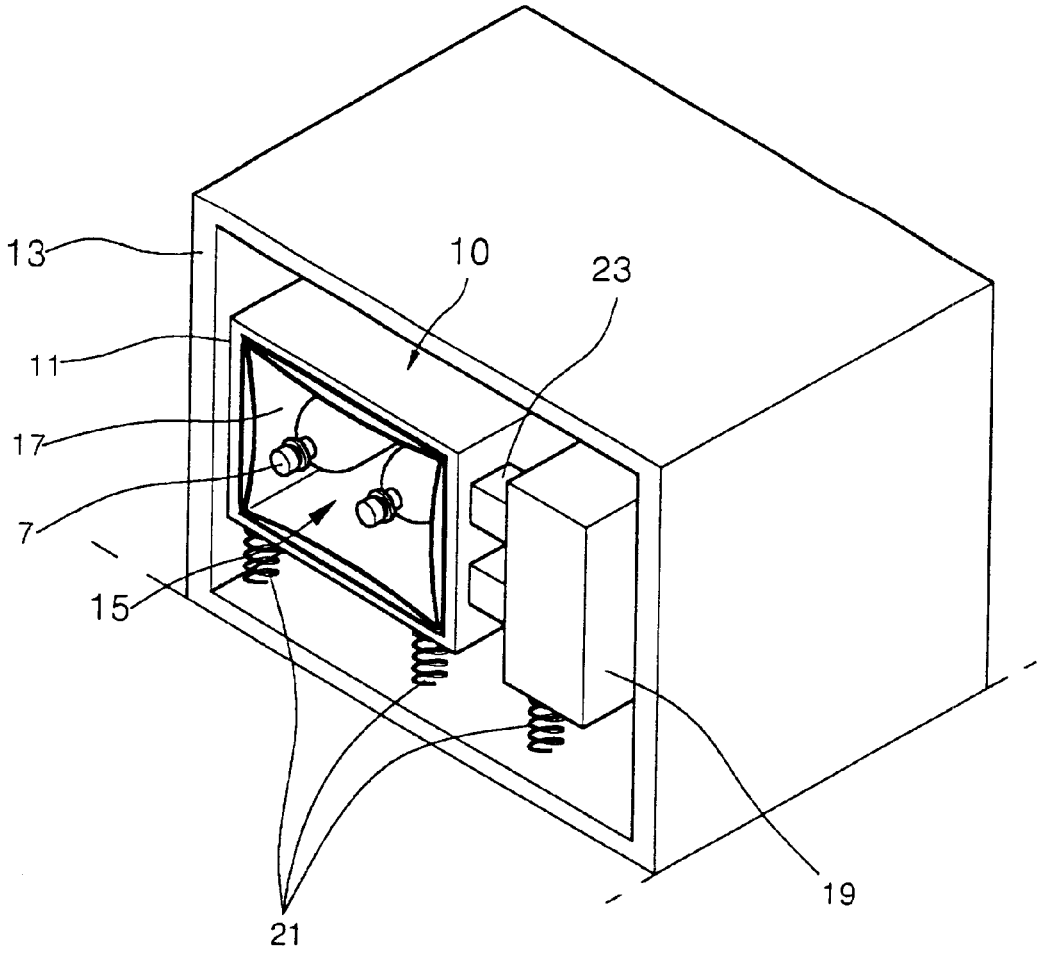
FIG. 3 is a perspective view of a rapid cooling apparatus according to a preferred embodiment of the invention.

FIG. 3 is a perspective view of a rapid cooling apparatus according to a preferred embodiment of the invention.

Referring to FIG. 3, the rapid cooling apparatus comprises storage means 10 equipped with a cold material bag 17, vibration means 19 for laterally vibrating the storage means and spacer means 21 for separating the storage and vibration means 10 and 19 from the outside.

Figure 5:
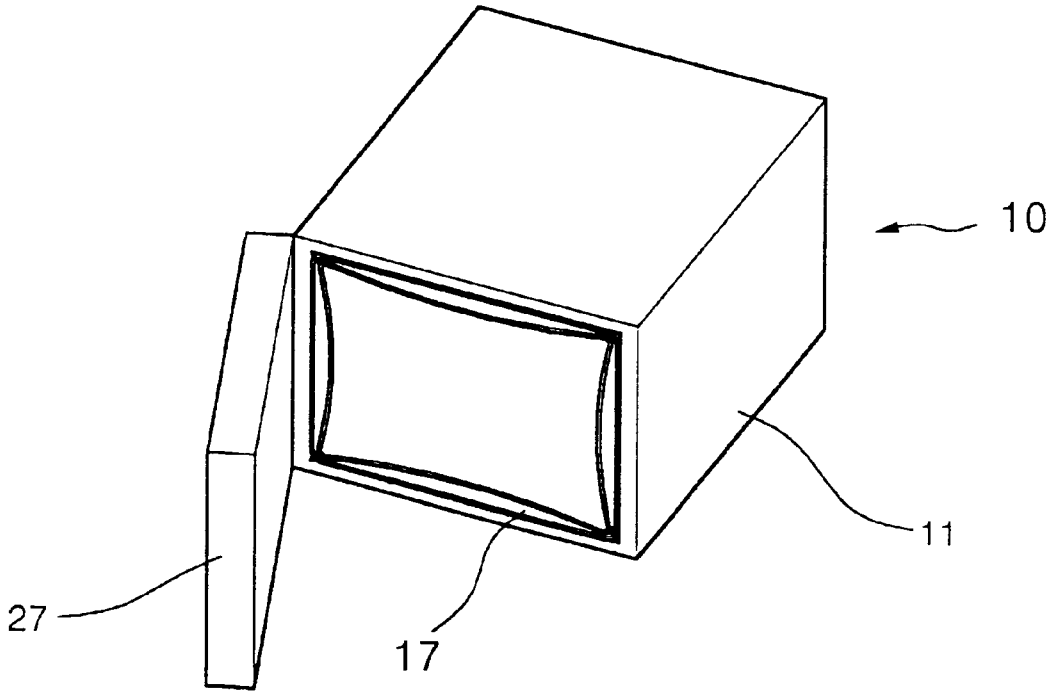
FIG. 5 is a perspective view of box-shaped storage means having a door shown in FIG. 3.

Within the first storage housing 11 shaped as a box, the storage means 10 is equipped with the cold material bag 17 filled with cold material 25 as shown in FIG. 5. The storage means 10 can be provided with a storage space 15 which can store objects 7 to be cooled within the same. Further, the storage means is provided in one side with a door 27 which can be opened/closed to store the objects 7 to be cooled.

Figure 4:
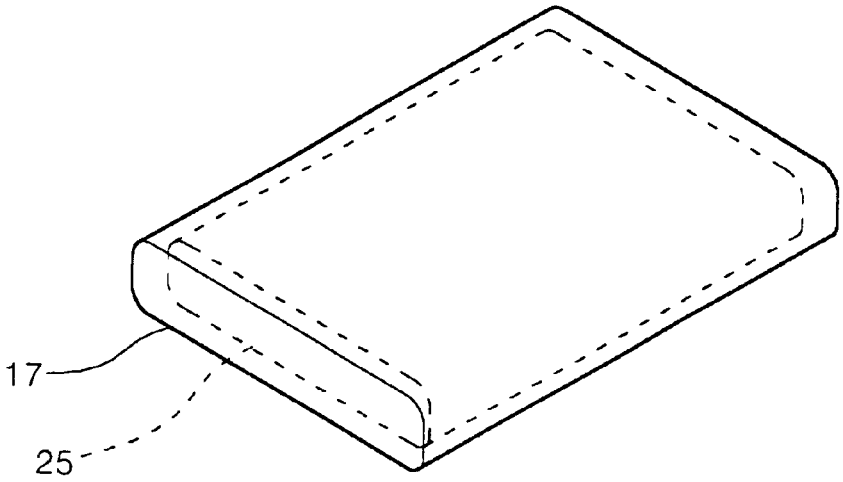
FIG. 4 is a perspective view of a cold material shown in FIG. 3.

Therefore, the objects 7 to be cooled facially contact with the cold material bags 17 in the storage space 15. As shown in FIG. 4, the cold material bags 17 are filled with cold material 25, and preferably installed within the first storage housing 11 on inside walls including four lateral walls, the ceiling and the bottom. Further, cold material is preferably saline solution or ethyl alcohol. Such cold material is necessarily adjusted in temperature to maintain two-phase state, i.e. solid and liquid, due to the internal temperature of a freezing chamber. That is, where the temperature of saline solution or ethyl alcohol which is used as cold material is adequately adjusted, cold material maintains a properly mixed state of solid and liquid. At this time, the temperature range of the cold material is desirable to −16°~−22°. If the temperature of cold material is not properly adjusted, cold material transforms from liquid to solid at the internal temperature of the freezing chamber failing to properly perform facial contact with the objects to be cooled so that the objects may not be properly cooled. Therefore, adjusting the temperature of cold material as above can avoid cold material from completely transferring into solid at the internal temperature of the freezing chamber. Also, latent heat to be generated may be used in convective heat transfer when the cold material transfers solid into liquid.

Figure 6:
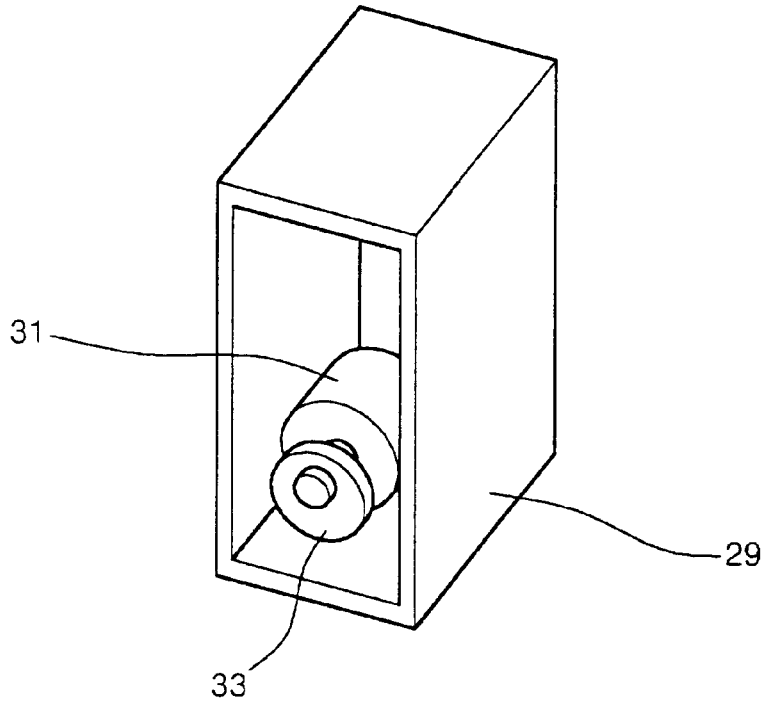
FIG. 6 is a perspective view of the internal structure of vibration means shown in FIG. 3.

As shown in FIG. 6, the vibration means 19 includes a vibration motor 31 fixed in a vibration housing 29 for generating rotation force and an eccentric weight 33 coupled to the shaft of the vibration motor 31 for generating vibration through eccentric rotation. The shaft of the vibration shaft is preferably coupled between the center and an outer edge of the eccentric weight 33. The eccentric weight 33 is rotated under the rotation of the vibration motor 31, in which eccentricity in rotation changes the direction of force thereby generating vibration.

The vibration housing 29 of the vibration means 19 is preferably fixed to the storage means 10 via connector shafts 23. Vibration from the eccentric weight 33 is transferred to the storage means 10 via the vibration housing 29 and the connector shaft 23 so as to shake the storage means 10.

It is preferred if the spacer means 21 are elastic members. The spacer means 21 distance the storage means 10 and the vibration means 19 from the second storage housing 13, allowing vibration from the vibration means 19 to be directly transferred to the storage means 10 while blocking vibration and noise from the vibration means and the storage means in respect to the outside.

As shown in FIG. 3, the rapid cooling apparatus primarily cools the objects 7 to be cooled via heat conduction with the cold material bags 17 furnished within the storage means 10 as well as shakes the objects 7 under vibration from the vibration means 19 uniformly mixing drinkable liquid both in central and peripheral portions to secondly cool the objects 7 via convective heat transfer. Accordingly, the rapid cooling apparatus can cool the objects to a low temperature more rapidly.

The above-mentioned rapid cooling apparatus rotates the vibration motor in a high speed in order to enhance cooling efficiency and thus it may disadvantageously consume a large amount of electric energy. In order to solve this problem, a method is provided to control the rotation rate of the vibration motor to correspond to the resonant frequency of the storage means which will be described hereinafter.

Figure 7:
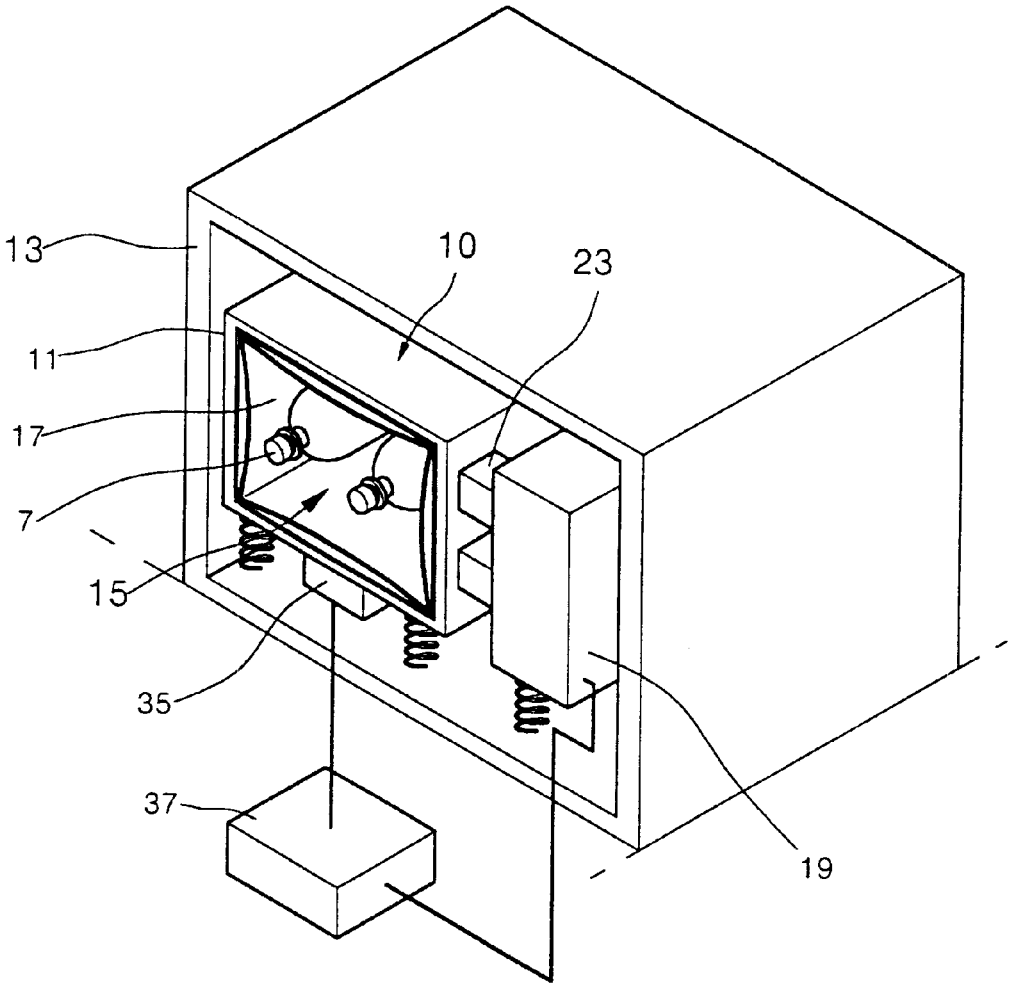
FIG. 7 is a perspective view of a rapid cooling apparatus according to another preferred embodiment of the invention.

FIG. 7 is a perspective view of a rapid cooling apparatus according to another preferred embodiment of the invention. Referring to FIG. 7, it can be seen that resonance means are further provided in addition to the components in FIG. 3, i.e. the vibration means 19, the storage means 10 and the spacer means 21. The resonance means may comprise detection means 35 and resonance controller means 37.

The detection means 35 can be attached to any side of the storage means 10. It is preferred that detection means 35 are a piezoelectric element or photosensor. The detection means converts vibration detected from the storage means to voltage signals which are outputted to the resonance controller means 37.

The resonance controller means 37 controls the rate of the vibration means 19 using the voltage signals from the detection means 35 so that an excitation frequency may correspond to the resonance frequency. The excitation frequency is calculated from vibration of the storage means 10, whereas the resonance frequency is set according to system characteristics of the storage means.

Figure 9:
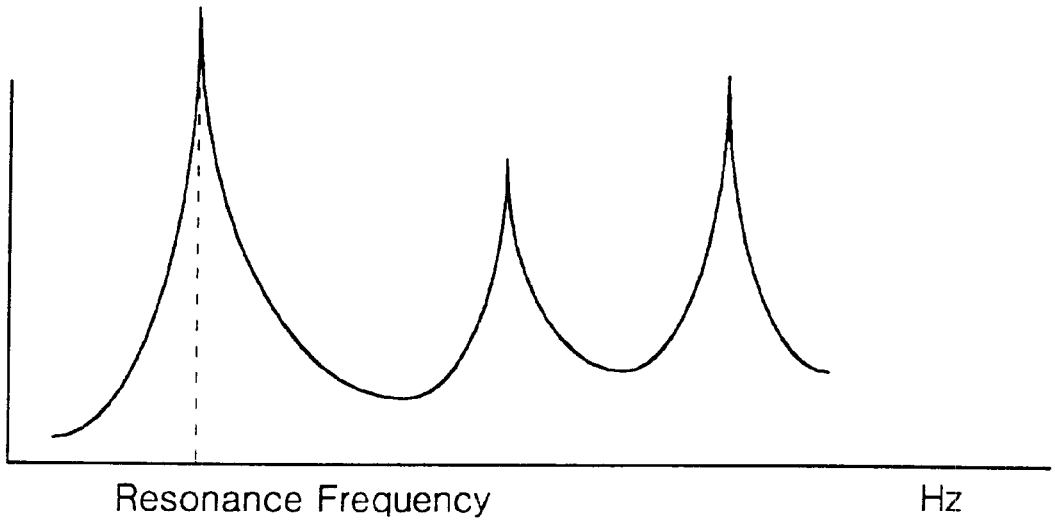
FIG. 9 is a graph of several resonance frequencies generated owing to vibration of a system in FIG. 7.

Generally in any system, as shown in FIG. 9, a plurality of resonance frequencies may exist. However, the resonance frequency in the application refers to the frequency corresponding to the maximum peak among the plurality of resonance frequencies.

Figure 8:
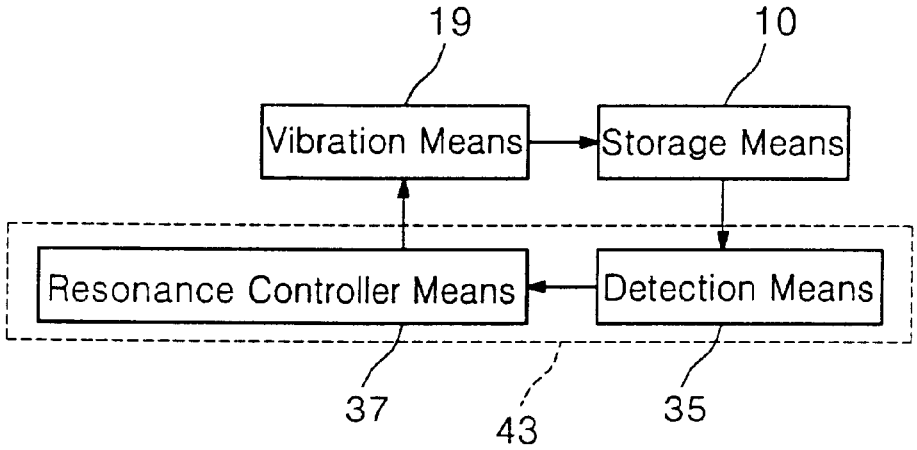
FIG. 8 is a block diagram of the construction of the rapid cooling apparatus shown in FIG. 7.

Describing this in more detail in reference to FIG. 8, it is required that the resonance frequency of the storage means 10 is known according experiment and so on. The storage means 10 is vibrated by the vibration means 19. In this case, the detection means 35 is attached to one side of the storage means 10 to converts vibration detected from the storage means into voltage, which is outputted to the resonance controller means 37.

The resonance controller means 37 calculates the excitation frequency based upon the voltage signals inputted from the detection means 35 and through variation thereof, and controls the rate of the vibration means so that the excitation frequency may correspond to the resonance frequency.

If the excitation frequency does not correspond to the resonance frequency, the resonance controller means 37 adjusts the rotation number of the vibration means to correspond to the resonance frequency and then re-detects vibration from the storage means 10 which vibrates according to the adjusted rotation number to re-calculate the excitation frequency. These processes are repeated until the excitation frequency matches with the resonance frequency.

Where the excitation frequency matches with the resonance frequency, the resonance controller means 37 continuously maintains the rate of the vibration means in the current state. At this time, vibration of the storage means 10 reaches the peak The rate of the vibration means is regulated to correspond to the resonance frequency with the detection means 35 and the resonance controller means 37 provided in the rapid cooling apparatus as set forth above so that vibration can be generated in the maximum amount with a little amount of electric energy.

In the rapid cooling apparatus as set forth above, the storage means 10 are box-shaped and shaken under vibration.

The following description will present that the vibration means are provided in a cylindrical configuration and rotated to mix liquid in central and peripheral portions of the objects to be cooled.

This allows two methods to be considered: The storage means can be rotated in one direction or both directions such as forward and reverse directions.

First, it will be described about the method of rotating the storage means in one direction.

Figure 10A:
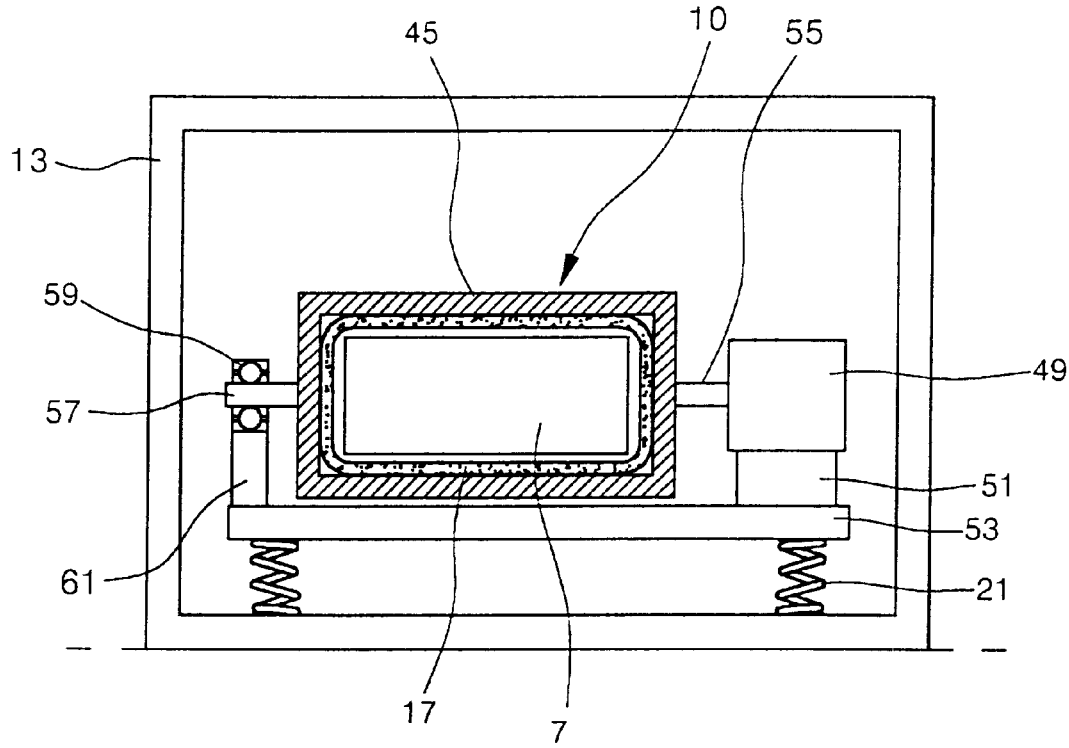
FIGS. 10A and 10B are schematic sectional views of a rapid cooling apparatus according to a further another preferred embodiment of the invention.
Figure 10B:
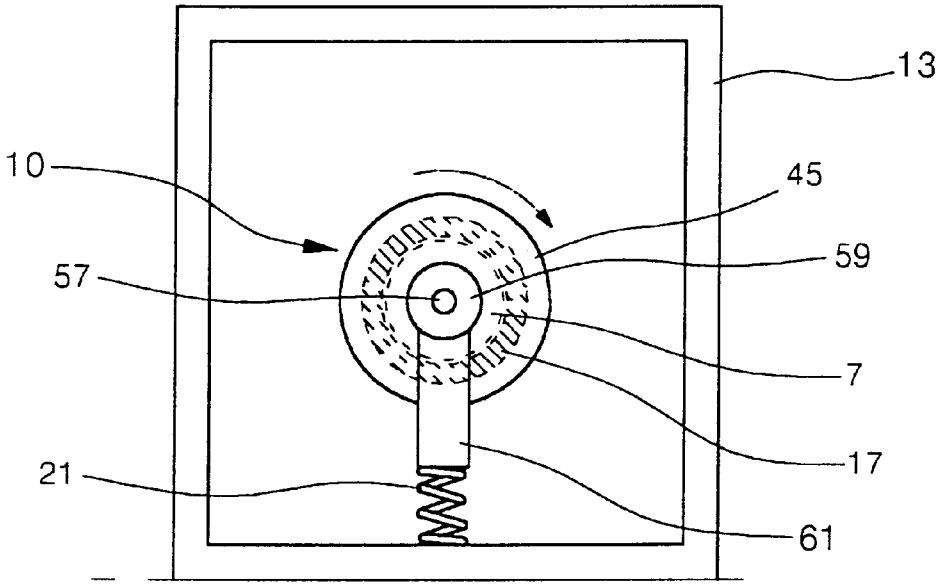

FIGS. 10A and 10B are front and side views of a rapid cooling apparatus according to a further another embodiment of the invention. Referring to FIGS. 10A and 10B, the rapid cooling apparatus comprises cylindrical storage means 10 and rotation means for rotating the storage means in one direction.

Figure 11:
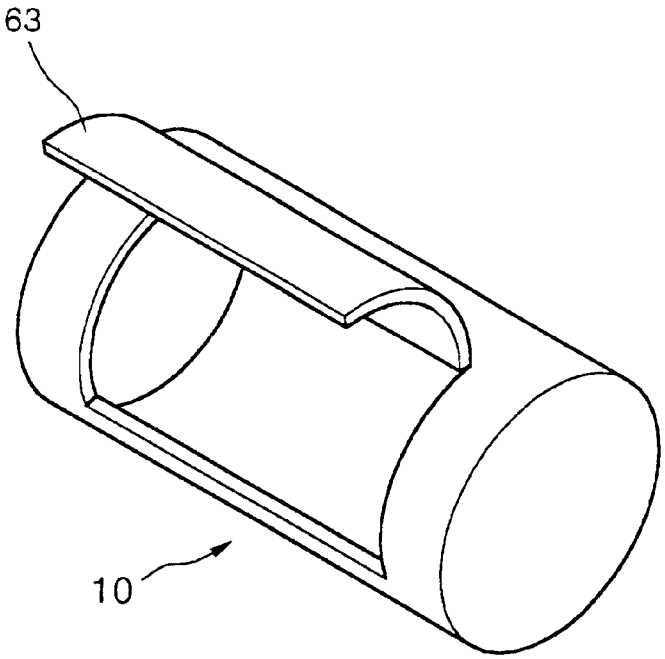
FIG. 11 is a perspective view of cylindrical storage means having a door shown in FIG. 10A.

The storage means 10 readily rotate due to cylindrical shape as shown in FIG. 11, and are provided in one side with a door 63 which is opened/closed for receiving objects 7 to be cooled.

In the storage means 10, cold material bags 17 are attached to inside walls of the first storage housing 45 as described already, and the objects 7 can be received to have facial contact with the cold material bags 17.

The rotation means comprise a rotation motor 49 fixed to a base plate 53 via a motor support 51 to generate rotation force for rotating the storage means 10, the first rotation shaft 55 for coupling between the rotation motor 49 and one side of the storage means 10 to transfer the rotation force and the second rotation shaft 57 for coupling between the other side of the storage means and a rotation shaft support 61 to support the storage means 10. Spacer means 21 may be further provided to distance the base plate 53 from the second storage housing 13. Of course, it is preferred that the spacer means 21 are elastic means having elastic restoring ability. On the base plate 53, the rotation shaft support 61 and the motor shaft 51 are fixedly mounted.

The base plate can be omitted so that the rotation shaft support 61 and the motor support 51 can be fixed to the second storage housing without the base plate.

The rotation shaft support 61 can be provided with bearings into which the first rotation shaft 55 is inserted. Therefore, the storage means 10 are rotated by the rotation motor 49 while being supported by the first rotation shaft 55 and the second rotation shaft 57.

The operation of the rapid cooling apparatus having the above configuration will be described as follows: A user stores the objects 7 desired to be cooled into the storage means 10 via the door 63. The objects 7 are primarily cooled via conductive heat transfer with the cold material bags 17. As the rotation motor 49 is actuated, the storage means 10 are rotated in one direction mixing liquid within the objects to be cooled. This creates convective heat transfer and thus secondary cooling so that the objects may be cooled rapidly.

Rotation the storage means like this can cool the objects more rapidly than vibrating the storage means in the above.

However, the rapid cooling apparatus of this embodiment rotates the storage means only in one direction so that liquid may be slowly mixed between central and peripheral portions thereby creating restriction in accelerating cooling rate. In order to overcome this restriction, it is provided a method for rotating the storage means in both directions which will be described hereinafter.

Figure 12:
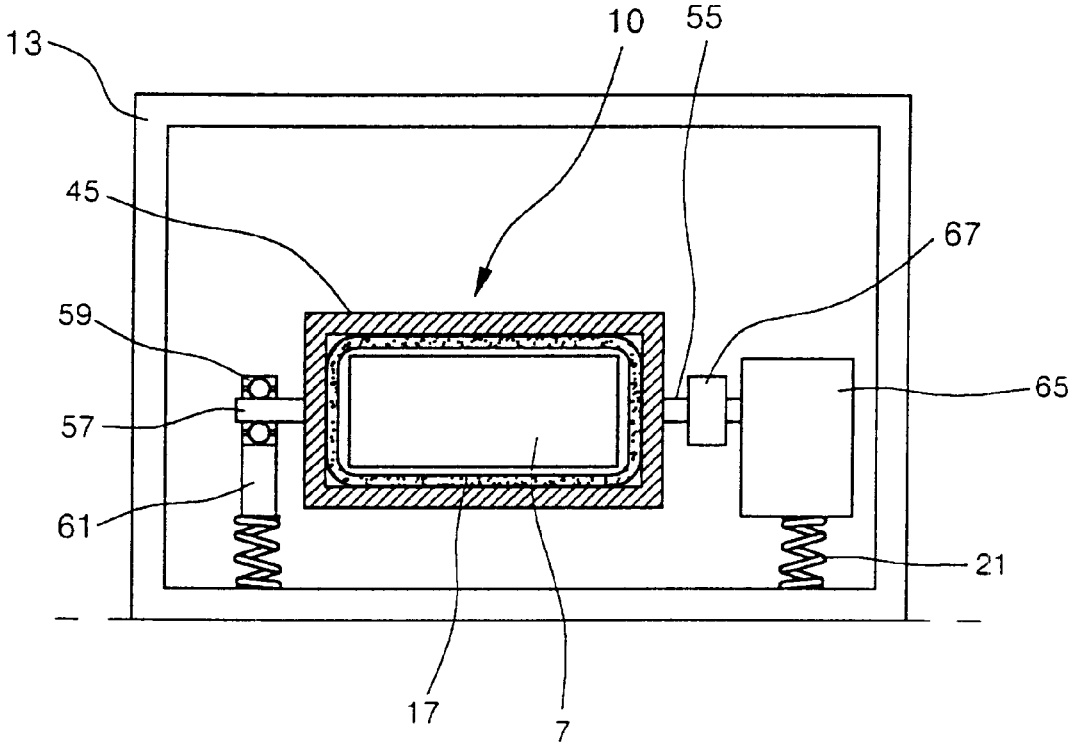
FIG. 12 is a schematic sectional view of a rapid cooling apparatus according to other preferred embodiment of the invention.

FIG. 12 is a schematic sectional view of a rapid cooling apparatus according to other preferred embodiment of the invention. Referring to FIG. 12, the rapid cooling apparatus further comprises a clutch 67 in respect to the apparatus shown in FIG. 10A. The clutch 67 switches rotation executed in one direction by a rotation motor 49 so that the rotation inverts its direction according to a predetermined time period.

Although spacer means 21 are connected to a rotation shaft support 61 and the rotation motor 49 in FIG. 12, the base plate 53 in FIG. 10A can be utilized.

Figure 13:
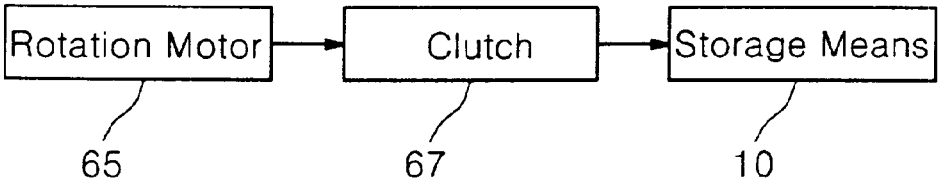
FIG. 13 is a block diagram of an exemplary construction of the rapid cooling apparatus shown in FIG. 12.

As shown in FIG. 13, objects 7 to be cooled received in storage means 10 are cooled by cold material bags 17 and the clutch 67 switches the rotation of the objects 7 executed in one direction by the rotation motor 49 to be changed in both directions, i.e. forward and reverse directions, so that more rapid cooling can be obtained.

Figure 14:
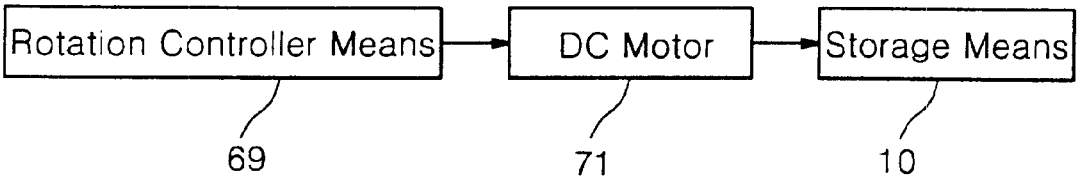
FIG. 14 is a block diagram of another exemplary construction of the rapid cooling apparatus shown in FIG. 12.

As shown in FIG. 14, a DC motor 71 can be used which can rotate in both of forward and reverse directions under the control of rotation controller means 69.

That is to say, the DC motor 71 can be rotated in the forward or reverse direction due to forward and reverse signals from the rotation controller means 69. Accordingly the rotation controller means 69 apply the forward and reverse signals to the DC motor 71 for a predetermined time period.

In the meantime, a method will be described in reference to FIG. 15 in which cold material bags 17 are maintained at a predetermined temperature to enhance cooling efficiency.

Figure 15:
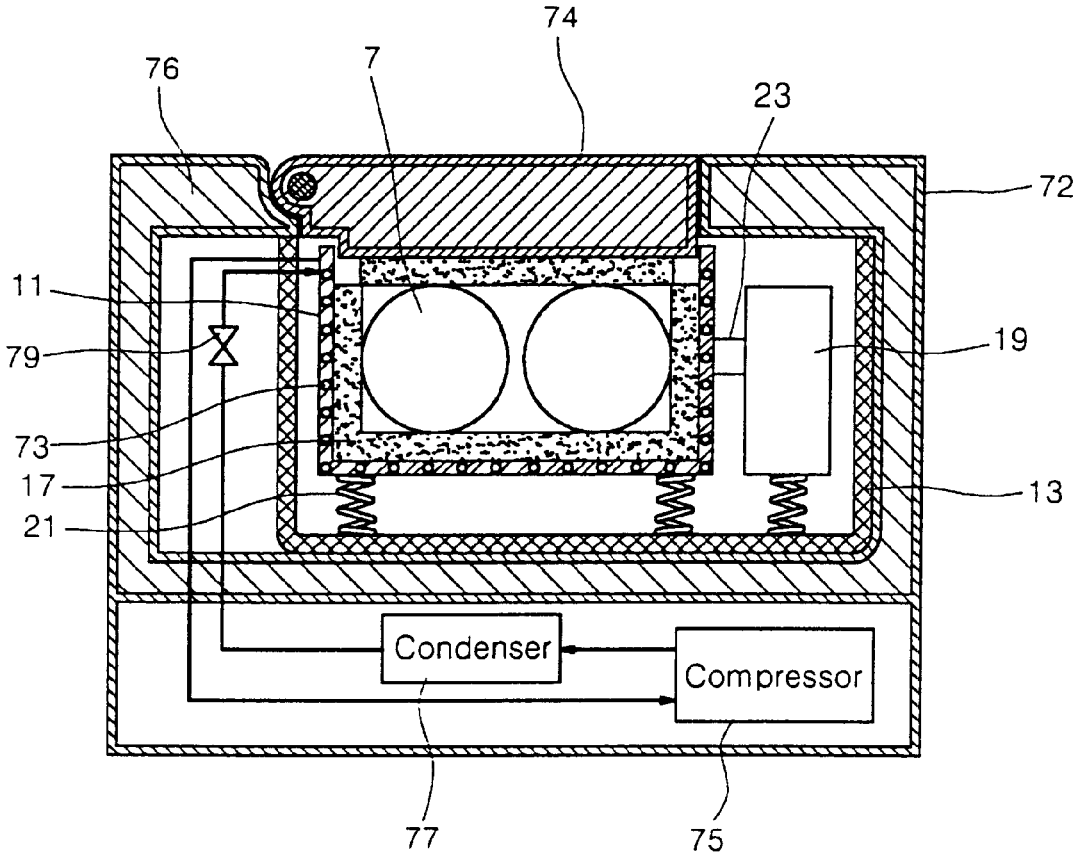
FIG. 15 is a schematic sectional view of a rapid cooling apparatus according to a still another preferred embodiment of the invention.

FIG. 15 is a schematic sectional view of a rapid cooling apparatus according to a still another preferred embodiment of the invention. In the rapid cooling apparatus shown in FIG. 15, a heat insulating body 76 is disposed within a body 72, the inside of the body 72 is divided into the first and second storage housings 11 and 13, and cold material bags 17 are attached within the first storage housing 11. In this case, the first storage housing 11 comprises an evaporators 73 laterally disposed with a predetermined gap. The evaporator 73 operates in cooperation with a cooling cycle including a compressor 75, a condenser 77, an expander 79 and the evaporator 73. The evaporator 73 evaporates coolant lowering the temperature of the cold material bags 17. This lowers the temperature of the cold material bags 17 to its original temperature as the cold material bags 17 is elevated in temperature owing to facial contact with objects 7 to be cooled. Also, the evaporator 73 lowers the temperature of air inside the second storage housing 13. The cooled air like this is heat insulated by the heat insulating body 76 provided within the body 72.

Figure 16:
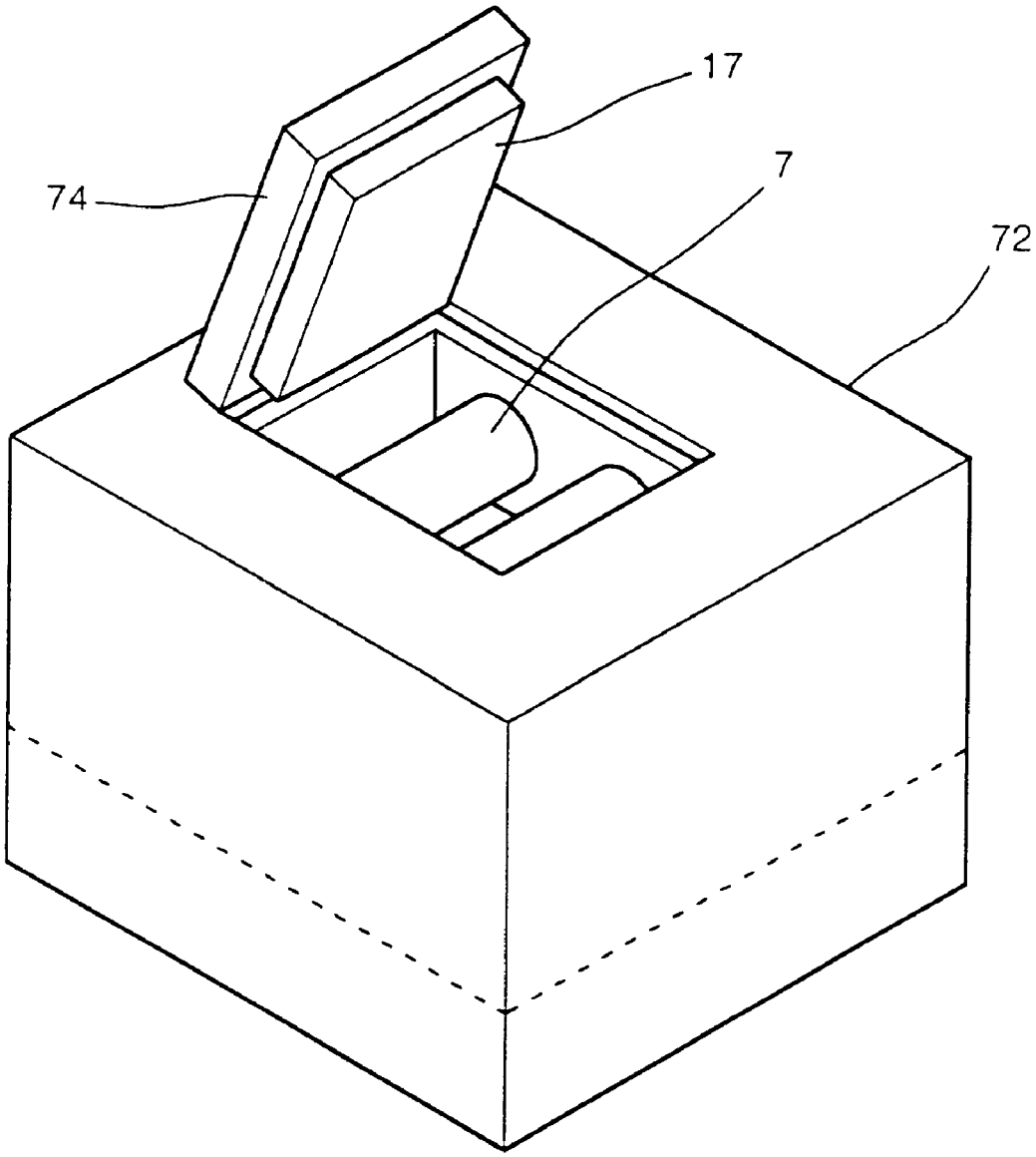
FIG. 16 is a perspective view of a body with a door shown in FIG. 15.

As shown in FIG. 16, in one side of an upper portion of the body 72, a door 74 may be provided for opening/closing the body to receive the objects 7. The cold material bags 17 are attached inside the door 74 to carry out facial contact with the objects 7 when the door is closed.

The first storage housing 11 is fixedly connected to vibration means 19 via a connector shaft 23. It shall be also understood that the vibration means 19 can be replaced by the rotation motor 49 or 65 shown in FIG. 10A or 12.

According to the rapid cooling apparatus as set forth above, conductive heat transfer owing to the cold material bags and convective heat transfer owing to vibration or rotation of the storage means can achieve rapid cooling in a very short time period allowing a user to enjoy cool drinkables so that the convenience of the user can be increased.

Further, the temperature of the cold material bags are maintained uniform with the evaporators cooperative with the cooling cycle so that cooling efficiency can be enhanced.

Although the embodiments of the invention have been described only in respect to the refrigerator, it will be understood by those skilled in the art that the rapid cooling apparatus of the invention can be applied to any constructions which need rapid cooling according to the appended claims.

What is claimed is:

1. A rapid cooling apparatus for rapidly cooling objects to be cooled, comprising:

means having a storage space disposed inside a first storage housing for storing the objects to be cooled and cold material bags disposed around the received objects to be cooled;

means for driving said storage means in a direction; and means for spacing said storage and driving means from a second storage housing.

2. The rapid cooling apparatus according to claim 1, wherein said cold material bags are filled with cold material and attached to inside walls.

3. The rapid cooling apparatus according to claim 2, wherein said cold material comprises ethyl alcohol which maintains two-phase state at a regular temperature range.

4. The rapid cooling apparatus according to claim 2, wherein said cold material comprises saline which maintains two-phase state at a regular temperature range.

5. The rapid cooling apparatus according to claim 1, further comprising an evaporator inserted into said first storage housing.

6. The rapid cooling apparatus according to claim 5, wherein said evaporator uniformly maintains the temperature of the cold material bags.

7. The rapid cooling apparatus according to claim 5, wherein said evaporator is operated in cooperation with a cooling cycle.

8. The rapid cooling apparatus according to claim 1, further comprising heat insulating material disposed outside said second storage housing.

9. The rapid cooling apparatus according to claim 1, wherein the objects to be cooled are cooled via facial contact with said cold material bags.

10. The rapid cooling apparatus according to claim 1, wherein said driving means comprise vibration means for vibrating said storage means.

11. The rapid cooling apparatus according to claim 10, wherein said vibration means are fixed to said storage means via a connector shaft.

12. The rapid cooling apparatus according to claim 10, wherein said vibration means include:

a vibration motor fixed inside a vibration housing; and an eccentric weight rotating as coupled to a shaft of said vibration motor.

13. The rapid cooling apparatus according to claim 12, wherein said shaft of the vibration motor is coupled between a central portion and an outside edge of said eccentric weight.

14. The rapid cooling apparatus according to claim 1, wherein said driving means comprise rotation means for rotating said storage means.

15. The rapid cooling apparatus according to claim 1, wherein said spacing means comprise an elastic member.

16. The rapid cooling apparatus according to claim 1, further comprising resonance means for controlling so that an excitation frequency corresponds to a resonant frequency.

17. A rapid cooling system for rapidly cooling objects to be cooled, comprising:

means having a storage space disposed inside a first storage housing for storing the objects to be cooled and cold material bags disposed around the received objects to be cooled;

means for laterally vibrating said storage means;

resonance means for controlling so that an excitation frequency detected from said storage means corresponds to resonance frequency; and means for spacing said storage and vibration means from a second storage housing.

18. The rapid cooling system according to claim 17, wherein said cold material bags comprises cold material which maintains two-phase state at a regular temperature range.

19. A rapid cooling system for rapidly cooling objects to be cooled, comprising:

means having a storage space disposed inside a first storage housing for storing the objects to be cooled and cold material bags disposed around the received objects to be cooled;

means for rotating said storage means in a reciprocating direction; and rotation control means for controlling said rotation means to rotate in the reciprocating direction.

20. The rapid cooling system according to claim 19, wherein said cold material bags comprises cold material which maintains two-phase state at the regular temperature range.

21. A rapid cooling apparatus for rapidly cooling objects to be cooled, comprising:

means having a storage space disposed inside a first storage housing for storing the objects to be cooled, cold material bags disposed around the received objects to be cooled and an evaporator inserted into said first storage housing;

means for driving said storage means in a direction; and means for spacing said storage and driving means from a second storage housing.

22. The rapid cooling system according to claim 21, wherein said cold material bags comprises cold material which maintains two-phase state at the regular temperature range.

23. A rapid cooling apparatus for rapidly cooling objects to be cooled, comprising:

means having a storage space disposed inside a first storage housing for storing the objects to be cooled and cold material bags disposed around the received objects to be cooled;

means for laterally vibrating said storage means; and means for spacing said storage and vibration means from a second storage housing.

24. The rapid cooling apparatus according to claim 23, wherein said cold material bags comprises cold material which maintains two-phase state at the regular temperature range.

25. A rapid cooling apparatus for rapidly cooling objects to be cooled, comprising:

means having a storage space disposed inside a first storage housing for storing the objects to be cooled and cold material bags disposed around the received objects to be cooled;

means for rotating said storage means and having a first rotation shaft and a second rotation shaft, said first rotation shaft being extended from one side of said storage means to a rotation motor, and said second rotation shaft extended from the other side of said storage means and inserted into a rotation shaft support; and means for spacing said storage and vibration means from a second storage housing.

26. The rapid cooling apparatus according to claim 25, wherein said cold material bags comprises cold material which maintains two-phase state at the regular temperature range.

27. A rapid cooling system for rapidly cooling objects to be cooled, comprising:

means having a storage space disposed inside a first storage housing for storing the objects to be cooled and cold material bags disposed around the received objects to be cooled;

means for laterally rotating said storage means;

resonance control means for calculating an excitation frequency based upon variation in voltage detected from vibration of said storage means, and controlling the rate of said vibration means so that the excitation frequency corresponds to the resonant frequency; and means for spacing said storage and vibration means from a second storage housing.

28. The rapid cooling system according to claim 27, wherein said cold material bags comprise cold material which maintains two-phase state at a regular temperature range.

29. The rapid cooling system according to claim 17, wherein said cold material includes one of ethyl alcohol or saline.

30. The rapid cooling system according to claim 17, wherein said vibration means include:

a vibration motor fixed inside a vibration housing;

an eccentric weight rotating as coupled to a shaft of said vibration motor; and connector shafts fixed between a vibration housing and said storage means.

31. The rapid cooling system according to claim 30, wherein vibrations generated by rotation of the eccentric weight rotating is transferred to the connector shafts via the vibration housing and the storage means.

32. The rapid cooling system according to claim 17, wherein said spacing means includes an elastic member.

33. The rapid cooling system according to claim 17, wherein said resonance means includes:

a detection means for detecting an excitation frequency from said storage means; and a resonance controller means for controlling the rate of the vibration means so that the excitation frequency remains the same as the resonance frequency.

34. The rapid cooling system according to claim 33, wherein said resonance frequency is the maximum peak frequency among many resonance frequencies.

35. The rapid cooling system according to claim 33, wherein said detection means is one of a piezoelectric element or photosensor.

36. The rapid cooling system according to claim 33, wherein said resonance controller means controls the rate of the vibration means until the excitation frequency becomes the same as the resonance frequency.

* * * * *